US011371268B2

(12) United States Patent
Graute et al.

(10) Patent No.: US 11,371,268 B2
(45) Date of Patent: Jun. 28, 2022

(54) MOTOR VEHICLE LOCK

(71) Applicant: Brose Schliesssysteme GmbH & Co. Kommanditgesellschaft, Wuppertal (DE)

(72) Inventors: Ludger Graute, Essen (DE); Roman Joschko, Dormagen (DE); Andreas Hoffmann, Voerde (DE); Pan Ren, Duesseldorf (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 551 days.

(21) Appl. No.: 16/306,237

(22) PCT Filed: May 26, 2017

(86) PCT No.: PCT/EP2017/062730
§ 371 (c)(1),
(2) Date: Nov. 30, 2018

(87) PCT Pub. No.: WO2017/207422
PCT Pub. Date: Dec. 7, 2017

(65) Prior Publication Data

US 2019/0211588 A1 Jul. 11, 2019

(30) Foreign Application Priority Data

Jun. 2, 2016 (DE) ..... 10 2016 110 201.6

(51) Int. Cl.
*E05B 79/00* (2014.01)
*E05B 79/08* (2014.01)
(Continued)

(52) U.S. Cl.
CPC ..... *E05B 79/08* (2013.01); *E05B 79/20* (2013.01); *E05B 2015/041* (2013.01)

(58) Field of Classification Search
CPC ..... E05B 79/08; E05B 79/20; E05B 2015/041
(Continued)

(56) References Cited

U.S. PATENT DOCUMENTS 2,723,872 A * 11/1955 Schonitzer ..... E05B 77/00 292/216
5,067,758 A * 11/1991 Fann ..... E05B 3/065 292/347

(Continued)

FOREIGN PATENT DOCUMENTS

DE 2101694 7/1972
DE 10232184 2/2004

(Continued)

OTHER PUBLICATIONS

"German Search Report," for Priority Application No. 102016110201.6 dated Jul. 3, 2017 (8 pages).

(Continued)

*Primary Examiner* — Suzanne L Barrett
(74) *Attorney, Agent, or Firm* — Pauly, DeVries Smith & Deffner LLC

(57) ABSTRACT

The disclosure relates to a motor vehicle lock with a lock mechanism and with a lock housing to receive the lock mechanism, wherein the lock mechanism comprises at least one activating lever which can swivel about a geometrical lever axis, wherein a bearing sleeve element is provided, on which the activating lever is radially mounted, wherein the activating lever is mounted on the bearing sleeve element axially at both sides and for this it is coupled to the bearing sleeve element by a bayonet fitting and in the process of installing the motor vehicle lock the activating lever and the bearing sleeve element can be premounted to form a separate unit by creating the bayonet fitting.

20 Claims, 4 Drawing Sheets

(51) Int. Cl.
*E05B 79/20* (2014.01)
*E05B 15/04* (2006.01)

(58) Field of Classification Search
USPC ..... 70/157
See application file for complete search history.

(56) References Cited

U.S. PATENT DOCUMENTS

| | | | | |
|---|---|---|---|---|
| 7,137,657 | B2 * | 11/2006 | Wu | E05B 15/02 292/357 |
| 7,559,586 | B2 * | 7/2009 | Fukunaga | E05B 81/06 292/201 |
| 8,613,160 | B2 * | 12/2013 | Matsumoto | E05B 83/40 49/279 |
| 2015/0247346 | A1 | 9/2015 | Yamane et al. | |
| 2017/0198505 | A1 * | 7/2017 | Hansen | E05B 85/06 |
| 2019/0291543 | A1 * | 9/2019 | Couto Maquieira | B60J 5/0416 |
| 2019/0351952 | A1 * | 11/2019 | Hunt | E05B 81/14 |
| 2020/0190864 | A1 * | 6/2020 | Brickner | E05B 79/10 |
| 2021/0032910 | A1 * | 2/2021 | Fuchs | E05B 79/20 |

FOREIGN PATENT DOCUMENTS

| | | |
|---|---|---|
| DE | 202007007077 | 9/2007 |
| DE | 102013208652 | 11/2014 |
| DE | 102014114580 | 4/2016 |
| JP | H08333937 | 12/1996 |
| JP | 2006233507 | 9/2006 |
| JP | 2007197972 | 8/2007 |
| WO | 2017207422 | 12/2017 |

OTHER PUBLICATIONS

"International Search Report and Written Opinion" for PCT Application No. PCT/EP2017/062730 dated Sep. 15, 2017 (11 pages).

* cited by examiner

MOTOR VEHICLE LOCK

CROSS-REFERENCE TO RELATED APPLICATIONS

This application is a national stage application under 35 U.S.C. 371 of International Patent Application Serial No. PCT/EP2017/062730, entitled "Motor Vehicle Lock," filed May 26, 2017, which claims priority from German Patent Application No. DE 10 2016 110 201.6, filed Jun. 2, 2016, the disclosure of which is incorporated herein by reference.

FIELD OF THE TECHNOLOGY

The disclosure relates to a motor vehicle lock as well as a method for installing such a motor vehicle lock.

BACKGROUND

The motor vehicle lock in question can be used with all kinds of closure elements of a motor vehicle. This includes doors, especially side doors or rear doors, trunk lids, tailgates, engine hoods, cargo area floors, or the like.

The compactness of the motor vehicle lock in question is of particular significance. In this regard, the motor vehicle lock is outfitted with bearing domes, on which a plurality of levers are mounted, axially spaced apart from each other. The resulting lever stack is often supported by spacing sleeves against housing components.

One challenge is to maintain a defined axial position of the levers of the lever stack, since geometrical tolerances of the components involved must always be expected.

SUMMARY

The problem which the disclosure proposes to solve is to specify a motor vehicle lock enabling a tolerance-insensitive mounting of multiple levers in particular on a geometrical lever axis with little manufacturing expense.

The above problem is solved by a motor vehicle lock with the features as described herein.

The proposed motor vehicle lock is outfitted with a lock mechanism and a lock housing to receive the lock mechanism. The lock mechanism comprises at least one activating lever which can swivel about a geometrical lever axis, wherein a bearing sleeve element is provided, on which the activating lever is radially mounted.

The activating lever is mounted on the bearing sleeve element not only radially, but also axially. It is important here that the activating lever is coupled to the bearing sleeve element by a bayonet fitting for an axially two-sided mounting. Further, it is important that in the process of installing the motor vehicle lock the activating lever and the bearing sleeve element can be premounted to form a separate unit by creating the bayonet fitting.

What is interesting in the proposed solution is the fact that a bearing sleeve element is provided which on the one hand can be used as a spacer in the above sense and on the other hand as an axially two-sided bearing for the activating lever. Thanks to this dual use of the bearing sleeve element, bearing components can be economized. Moreover, the creating of the bayonet fitting in a premounting process provides the basic possibility of a parallel performance on installation processes.

The design of the axial closure between the activating lever and the bearing sleeve element as a bayonet fitting is advantageous inasmuch as the creating of the bayonet fitting can occur with simple installation movements, especially in automated manner, and the bayonet fitting can provide a secure, axially two-sided mounting of the activating lever with no major mechanical expense.

Various embodiments relate to variants for the creating of the bayonet fitting. Some embodiments afford the possibility of a simple premounting of activating lever and bearing sleeve element in that no precise and therefore expensive installation movements are required given the premounting and a suitable design. In another embodiment, an unlocking of the bayonet locking is blocked in the installed condition of the motor vehicle lock simply by a movement limitation of activating lever and bearing sleeve element. Thus, no separate locking element is needed for the locking of the bayonet lock.

In some embodiments, the bearing sleeve element is supported axially on two sides and can accordingly serve as a spacer. The possible dual function of the bearing sleeve element comes into play here, namely, as a spacer on the one hand and as a bearing for the activating lever on the other hand.

Some embodiments relate to interactions of the bearing sleeve element with a bearing dome of the motor vehicle lock.

Axial support of the bearing sleeve element against a shoulder of the bearing dome ensures that the position of the activating lever is determined only by the geometrical tolerances of the bearing dome, and not by geometrical tolerances of possible additional levers.

Such additional levers are included in various embodiments. The bearing sleeve element here provides an axial support, i.e., an axial mounting, for at least one additional lever. Because the bearing sleeve element can be mounted on the bearing dome provides at the same time an axial bearing for at least one additional lever, the building up of unwanted tolerance chains from one lever to the other can be reliably avoided.

According to various embodiments, a method is provided for installing a motor vehicle lock according to the first mentioned teaching. Accordingly, one should refer to all the remarks about the first mentioned teaching.

It is important according to the additional teaching that the activating lever and the bearing sleeve element in a premounting step form a premounted unit by forming the bayonet fitting, wherein the premounted unit is then mounted on the rest of the motor vehicle lock.

The premounting of activating lever and bearing sleeve element allows process steps to occur in parallel, wherein the proposed design of the bearing sleeve element ensures the maintaining of given tolerances.

Specifically, it is proposed that in a first step the at least one additional lever is attached to a bearing dome of the motor vehicle lock and in a second step the aforementioned premounted unit is attached to the bearing dome. The two steps of the method require installing movements along the common geometrical lever axis, so that an automated assembly is easily possible.

Various embodiments provide a motor vehicle lock with a lock mechanism and with a lock housing to receive the lock mechanism, wherein the lock mechanism comprises at least one activating lever which can swivel about a geometrical lever axis, wherein a bearing sleeve element is provided, on which the activating lever is radially mounted, wherein the activating lever is mounted on the bearing sleeve element axially at both sides and for this it is coupled to the bearing sleeve element by a bayonet fitting and in the process of installing the motor vehicle lock the activating lever and the bearing sleeve element can be premounted to form a separate unit by creating the bayonet fitting.

In some embodiments, the bearing sleeve element is designed rotationally fixed to the lock housing with respect to the lever axis, wherein the bearing sleeve element comprises a support arm which is supported, in a rotationally fixed manner with respect to the lever axis, relative to the lock housing.

In some embodiments, the bayonet fitting is formed by a bayonet shape on the bearing sleeve element on the one hand and by a mating bayonet shape on the activating lever on the other hand.

In some embodiments, the bayonet fitting can be brought into a locked condition and into an unlocked condition by swiveling the activating lever with respect to the bearing sleeve element about the lever axis and the bayonet fitting only provides the axially two-sided mounting between activating lever and bearing sleeve element in the locked condition, and in the unlocked condition it allows a mutual axial movement of activating lever and bearing sleeve element.

In some embodiments, the activating lever and the bearing sleeve element take up a locking swiveled position with respect to each other in the installed condition of the motor vehicle lock with respect to the bayonet fitting, wherein the activating lever and the bearing sleeve element are limited in their movement in the installed condition of the motor vehicle lock such that an unlocking of the bayonet fitting is blocked.

In some embodiments, the bearing sleeve element is supported axially on two sides, wherein the bearing sleeve element is axially supported against one portion of the lock housing, especially against a housing cover.

In some embodiments, the bearing sleeve element has an axial extension, wherein the bayonet shape is arranged on the axial extension, and/or wherein the axial extension serves for the axial support of the bearing sleeve element against the lock housing, especially against the housing cover, and/or wherein the axial extension serves for receiving a spring element, especially a helical spring element, for the activating lever or another component of the lock mechanism.

In some embodiments, a bearing dome is provided, and wherein the bearing sleeve element is arranged coaxially to the bearing dome, wherein the bearing sleeve element is attached to the bearing dome or inserted into the bearing dome or placed on the bearing dome, wherein the bearing dome is connected to a portion of the lock housing, especially as a single piece.

In some embodiments, the bearing sleeve element is axially supported against the bearing dome, especially against a radial shoulder of the bearing dome, wherein the bearing sleeve element is secured, in particular clamped, between the housing cover of the lock housing and the bearing dome.

In some embodiments, the lock mechanism comprises at least one additional lever, able to swivel about the geometrical lever axis, such as two further additional levers able to swivel about the lever axis, and wherein the at least one additional lever is mounted on the bearing dome.

In some embodiments, at least one additional lever is mounted axially on two sides, on the one hand by the bearing sleeve element, especially a radial shoulder on the bearing sleeve element, and on the other hand by the bearing dome, especially a radial shoulder on the bearing dome.

In some embodiments, the bearing sleeve element comprises an axial extension, which can be brought into engagement with an additional lever mounted on the bearing dome and which supports this additional lever axially at one side.

Various embodiments provide a method for mounting a motor vehicle lock as described herein, wherein the activating lever and the bearing sleeve element in a premounting step form a premounted unit by forming the bayonet fitting and wherein the premounted unit is mounted on the rest of the motor vehicle lock.

In some embodiments, the motor vehicle lock comprises a bearing dome and in a first step the at least one additional lever is attached to the bearing dome, and in a second step the premounted unit is attached to the bearing dome.

In some embodiments, in a third step a housing cover is placed on the rest of the lock housing, and the bearing sleeve element is thus supported axially.

BRIEF DESCRIPTION OF THE DRAWINGS

In the following, the disclosure shall be explained more closely with the aid of a drawing representing only one exemplary embodiment. The drawing shows FIG. 1 a motor vehicle door with a proposed motor vehicle lock in a view looking out from the interior of the motor vehicle, FIG. 2 one embodiment of the motor vehicle lock of FIG. 1 in an exploded view with the essential components for the disclosure, FIG. 3 the motor vehicle lock of FIG. 2 during the installing of the motor vehicle lock after the premounting of activating lever and bearing sleeve element and FIG. 4 the motor vehicle lock of FIG. 3 after the installing of the premounted unit on the rest of the motor vehicle lock.

DETAILED DESCRIPTION

Figure 1:
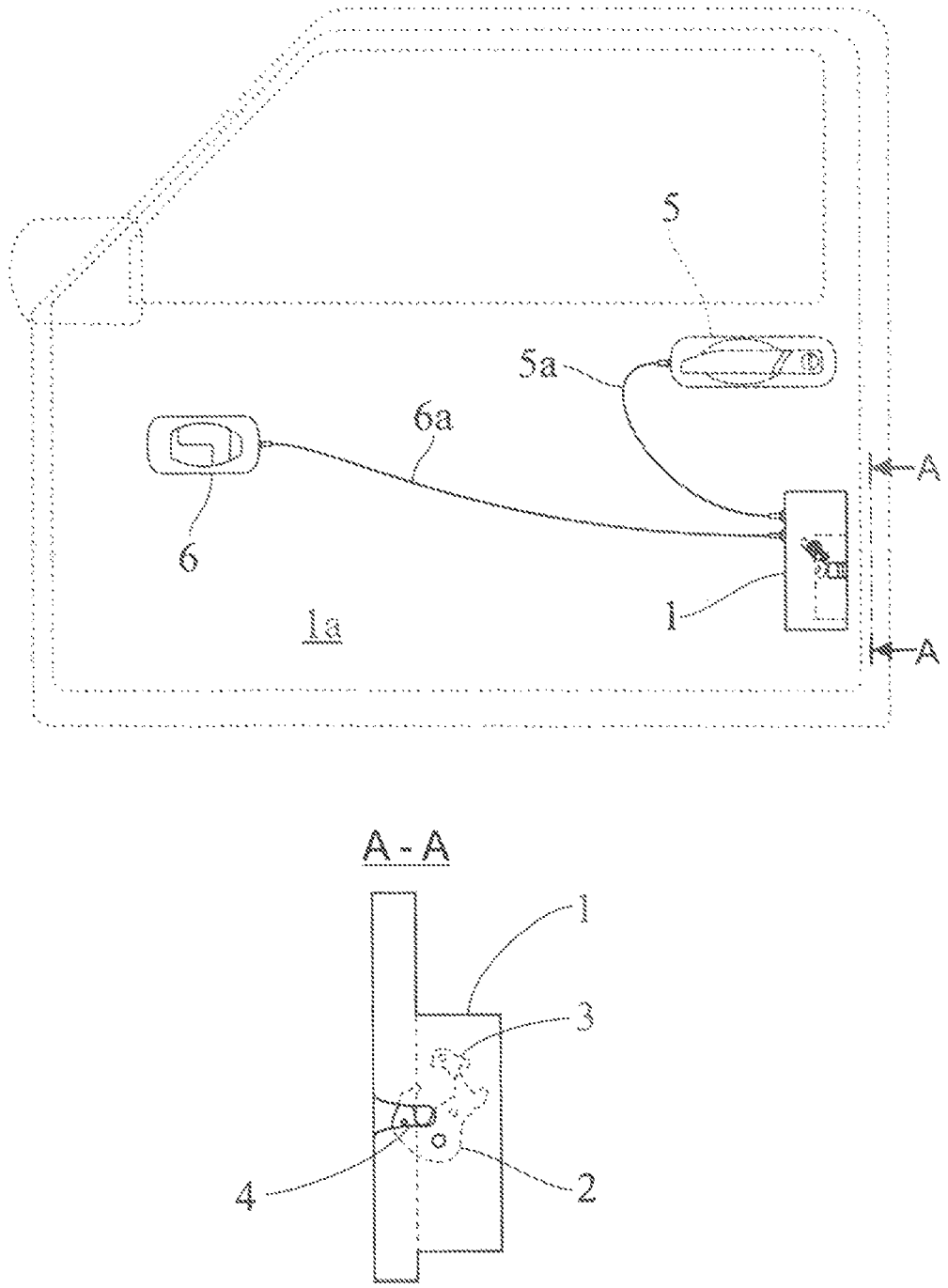

The motor vehicle lock 1 represented in the drawing is associated with a side door 1*a* of a motor vehicle. The motor vehicle lock 1 can basically be used for all kinds of closure elements of a motor vehicle. In this regard, refer to the introductory passage of the specification.

The basic layout of the motor vehicle lock 1 comprises the closure elements of a latch 2 and a ratchet 3, which interact with each other in the usual way. The latch 2 can be brought into at least one closing position, in which it stands in holding engagement with a closure element 4, especially a lock wedge or a striker. The latch 2 is held by the ratchet 3 in its closing position. The lifting of the ratchet 3 involves the releasing of the latch 2 into its open position, which entails a releasing of the closure element 4.

The side door 1*a* in the exemplary embodiment represented receives the motor vehicle lock 1, while the closure element 4 is arranged on the motor vehicle bodywork. The re-verse may also occur.

FIG. 1 further shows that an outside door handle 5 and an inside door handle 6 are provided, each being coupled by Bowden cables 5*a*, 6*a* to the motor vehicle lock 1. Depending on the closed condition of the motor vehicle lock 1, the ratchet 3 can be lifted by activating the outside door handle 5 or the inside door handle 6.

The represented motor vehicle lock 1 is outfitted with a lock mechanism 7 which encompasses here all the mechanical components needed to implement the locking functions. The lock mechanism 7 is received by a lock housing 8, which need not be of enclosed design. Accordingly, the term "lock housing" should be taken broadly. Basically, it may also be the case that a back plate or a closure plate is part of the lock housing 8*a* in this regard.

Figure 2:
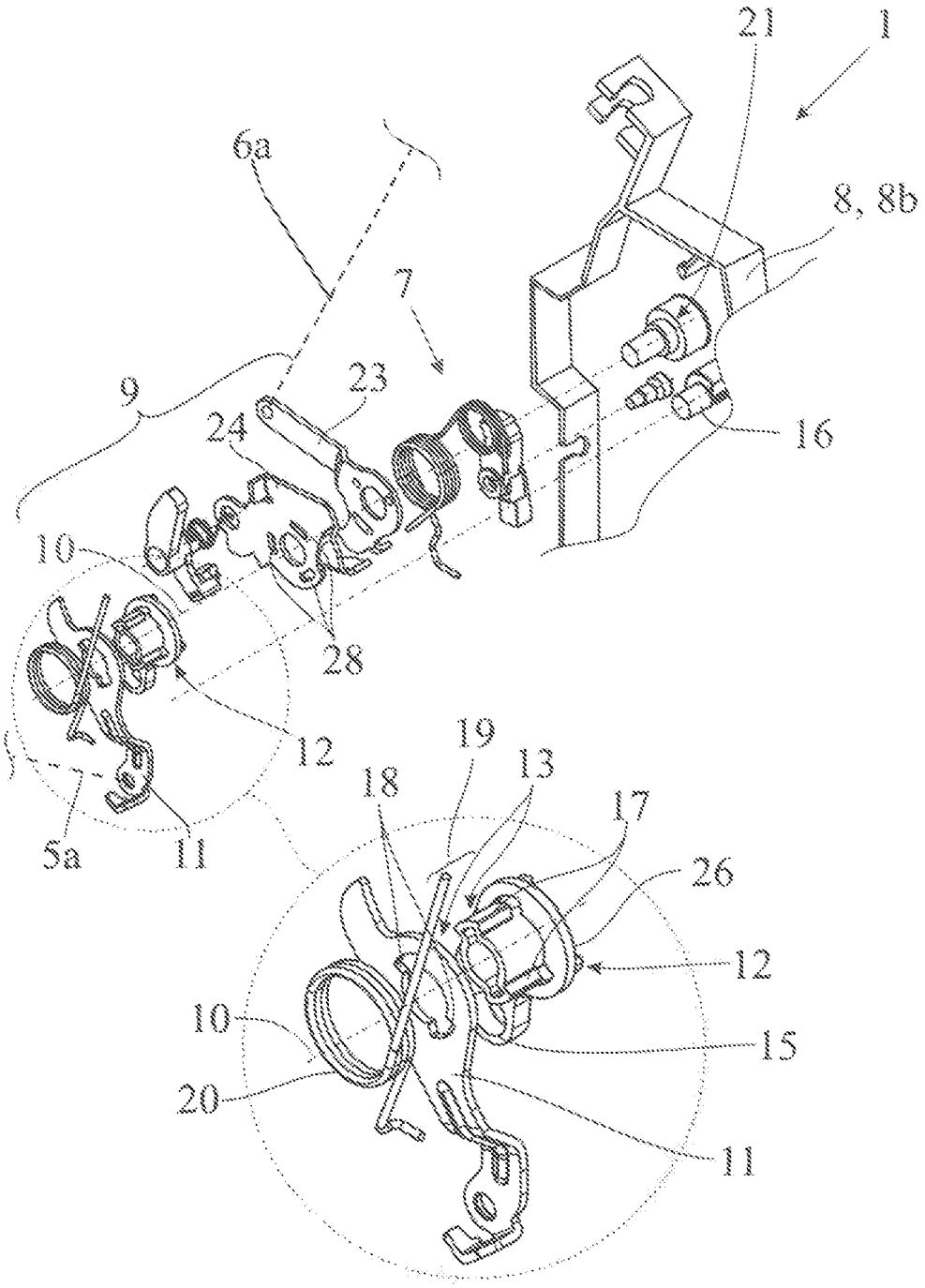

The proposed solution shall be explained in the following with the aid of a lever stack 9 of the lock mechanism 7. First of all, it is important that the lock mechanism 7 comprises at least one activating lever 11 which can swivel about a geometrical lever axis 10. Here the activating lever 11 is an outer activating lever, coupled by the Bowden cable 11*a* to the outside door handle 5. FIG. 2 shows that a bearing sleeve element 12 is provided, on which the activating lever 11 is radially mounted. This is best seen by viewing FIGS. 2, 3 and 4 together.

It should be pointed out that the terms "radially" and "axially" in the present instance should always be understood in regard to the geometrical lever axis 10 of the activating lever 11, without this being expressly pointed out each time.

Figure 3:
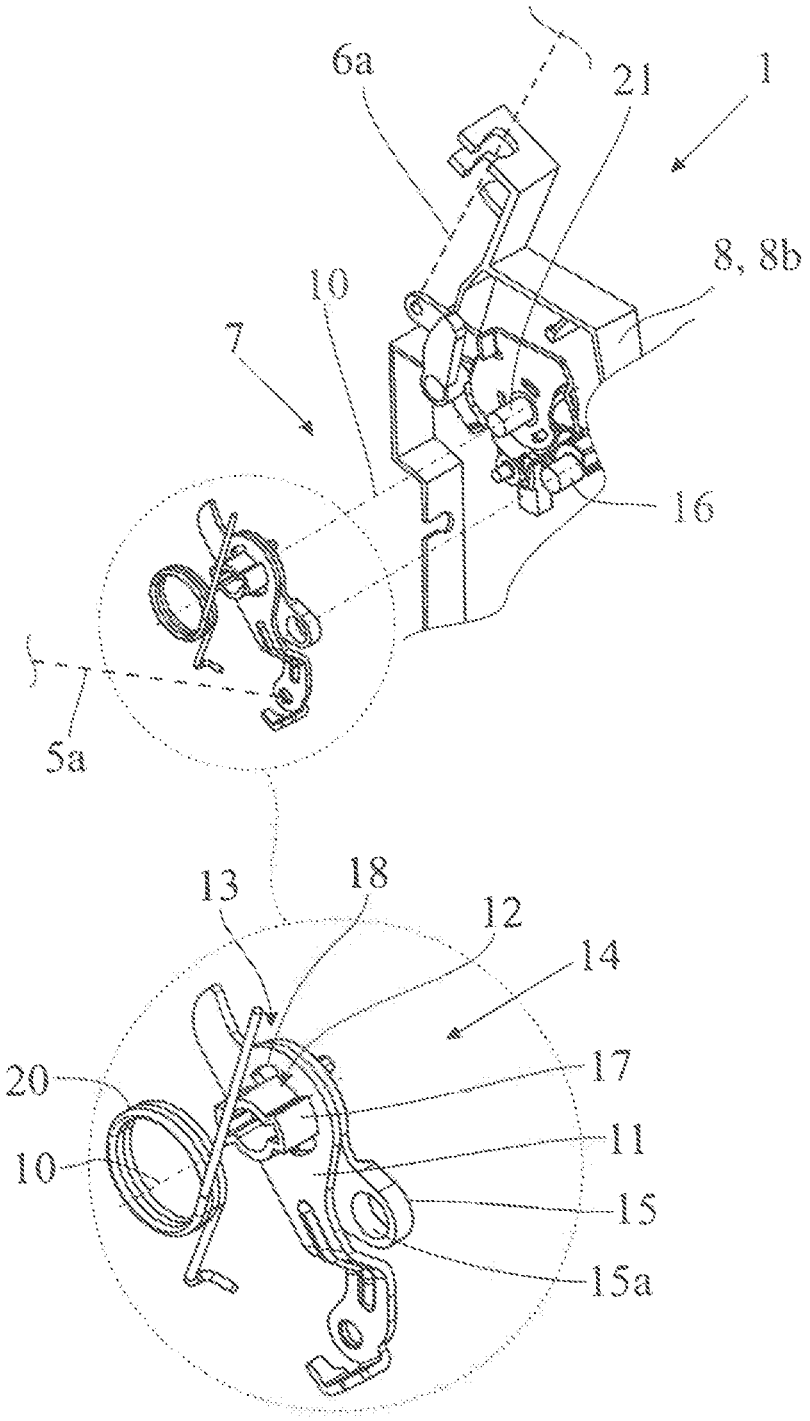
Figure 4:
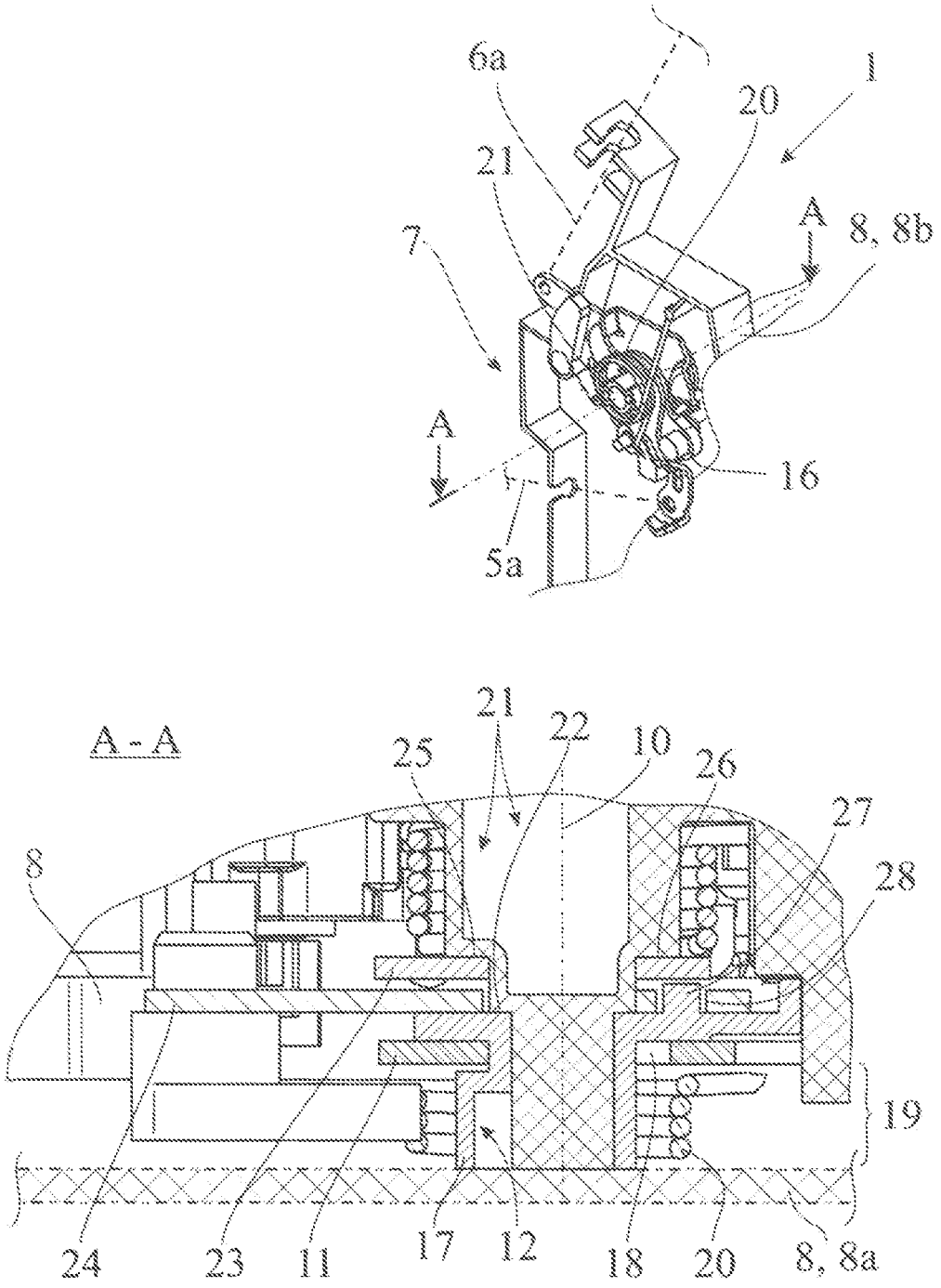

It emerges from the cross-sectional representation of FIG. 4 that the activating lever 11 is mounted axially two-sided on the bearing sleeve element 12. This means that the axial adjustability of the activating lever 11 is defined in both axial directions by the axially two-sided bearing. For this, the activating lever 11 is coupled to the bearing sleeve element 12 by a bayonet fitting 13. This emerges, once again, by viewing FIGS. 2, 3 and 4 together.

What is interesting about the proposed solution is the fact that, in the process of installing the motor vehicle lock 1, the activating lever 11 and the bearing sleeve element 12 can be premounted as a separate unit 14 by creating the bayonet fitting 13, as is shown in FIG. 3. The term "installing of the motor vehicle lock" here pertains to the production of the motor vehicle lock 1, and not just the installing of the motor vehicle lock 1 in the side door 1*a* or the like. The term "separate" means that the premounted unit 14 consisting of activating lever 11 and bearing sleeve element 12 as such can be created separately from the other components of the motor vehicle lock 1.

Basically, at least two activating levers 11, or more than two activating levers 11, can also be mounted on the bearing sleeve element 12.

It is furthermore conceivable for more than one bearing sleeve element 12 to be provided, or more than two bearing sleeve elements 12, each of them supporting at least one activating lever 11.

In order to prevent the bayonet fitting 13 from being released unintentionally when handling the premounted unit 14, a fixation arrangement (not shown) can be provided between activating lever 11 and bearing sleeve element 12. For example, the fixation arrangement can be a detent arrangement, which needs to be overcome when producing the bayonet fitting 13. It is also conceivable that crush ribs have to be crossed when producing the bayonet fitting 13, which ensure that the bayonet fitting cannot be released without an elevated expenditure of force.

A joint viewing of FIGS. 3 and 4 shows that the bearing sleeve element 12 is formed rotationally fixedly, with respect to the lever axis 10, with the housing 8. This is realized here in that the bearing sleeve element 12 has a support arm 15, which is supported, in a rotationally fixed manner with respect to the lever axis 10, relative to the lock housing 8. For this, the support arm 15 has an opening 15*a* which is pushed onto a bearing dome 16 during the mounting of the unit 14. The desired supporting effect is produced in that the bearing dome 16 is spaced apart from the lever axis 10.

In the exemplary embodiment represented, the bayonet fitting 13 is formed by a bayonet shape 17 on the bearing sleeve element 12 on the one hand and by a mating bayonet shape 18 on the activating lever 11 on the other hand. The components of activating lever 11 and bearing sleeve element 12 can be pushed together axially from the position represented in FIG. 2. By a swiveling of the activating lever 11 relative to the bearing sleeve element 12 about the lever axis 10, the bayonet fitting 13 can be brought into the locked condition shown in FIG. 3, in which the bayonet shape 17 and the mating bayonet shape 18 form an undercut. A backward swiveling results in the bayonet fitting 13 taking up its unlocked condition. It is important here that the axially two-sided mounting between activating lever and bearing sleeve element 12 can only be provided in the locked condition (FIG. 3). In the unlocked condition (FIG. 2), on the other hand, an axial movement of activating lever 11 and bearing sleeve element 12 is possible.

The use of a bayonet fitting 13 in the proposed solution makes possible an especially secure axially two-sided mounting of the activating lever 11 on the bearing sleeve element 12. Specifically, the activating lever 11 and the bearing sleeve element 12 in the installed condition of the motor vehicle lock 1 (FIG. 4) assume a locking swiveled position relative to each other with respect to the bayonet fitting 13, so that the bayonet fitting 13 is in its aforementioned locked condition. Furthermore, the arrangement here is such that the activating lever 11 and the bearing sleeve element 12 in the installed condition of the motor vehicle lock 1 are limited in their movement so that an unlocking of the bayonet fitting 13 is blocked.

The cross-sectional view of FIG. 4 shows that the bearing sleeve element 12 is supported axially on two sides. One support point is located on a portion of the lock housing 8, in this case on a housing cover 8*a* merely indicated in FIG. 4.

In the exemplary embodiment represented, the bearing sleeve element 12 comprises an axial extension 19, on which here the bayonet shape 17 is arranged. The axial extension 19 in the exemplary embodiment represented in the drawing has a further function, namely, the function of the axial support of the bearing sleeve element 12 against the lock housing 8, in this case against the housing cover 8*a*. The axial extension 19 in the exemplary embodiment represented takes on yet another function, namely, the function of receiving a spring element 20, being in an embodiment a helical spring element, for the activating lever 11. Basically, however, it is also conceivable for the spring element 20 to be associated with another component of the lock mechanism 7.

FIG. 4 shows that the bearing sleeve element 12 has the function of a spacer, by which the activating lever 11 is held at a predetermined spacing from the housing cover 8*a*.

For the mounting of the lever stack 9, yet to be explained in detail, the motor vehicle lock 1 comprises a further bearing dome 21, while the bearing sleeve element 12 as represented in FIG. 4 is arranged coaxially to the bearing dome 21. Here, the bearing sleeve element 12 is attached to the bearing dome 21. Alternatively, the bearing sleeve element 12 may be inserted into the bearing dome 21 or mounted on the bearing dome 21. The bearing dome 21 is connected to a portion of the lock housing 8, such as to a housing tray 8*b*, here as a single piece.

Thanks to the aforementioned attaching of the bearing sleeve element 12 to the bearing dome 21, an especially good centering of the bearing sleeve element 12 on the geometrical lever axis 10 results.

It has already been pointed out that the bearing sleeve element 12 by its axial extension 19 against the housing cover 8*a*. Here, it is provided that the bearing sleeve element 12 is axially supported at its end facing away from the housing cover 8*a* against the bearing dome 21, here against a radial shoulder 22 of the bearing dome 21. This means that the bearing sleeve element 12 can be secured between the housing cover 8*a* of the lock housing 8 and the bearing dome 21, in particular, clamped. Hence, additional steps are unnecessary for the fastening of the bearing sleeve element 12, which might involve for example an additional rivet connection or the like.

In some embodiments, the lock mechanism 7 comprises at least one additional lever 23, 24, here two additional levers 23, 24, able to swivel about the geometrical lever axis 10. The additional levers 23, 24 here are mounted on the bearing dome 21. The bearing points of the additional levers 23, 24 are axially spaced apart from the bearing point of the activating lever 11. The additional levers 23, 24 are, like the bearing sleeve element 12, attached to the bearing dome 21.

The additional lever 23 is the inner activating lever, which in the installed condition of the motor vehicle lock 1 is coupled by the Bowden cable 6*a* to the inside door handle 6. The additional lever 24 is a so-called release lever, which can be activated from the outside by the outer activating lever 11 and/or by the inner activating lever 23, depending on the closed condition, and which acts on the ratchet 3.

The two additional levers 23, 24 are arranged between a further radial shoulder 25 of the bearing dome 21 and a circumferential collar 26 of the bearing sleeve element 12 and are thus axially mounted on two sides. The axial mounting of the activating lever 11 on the one hand and the additional levers 23, 24 on the other hand have no alternating, tolerance-related influence on each other.

Furthermore, it is shown in FIG. 4 that the bearing sleeve element 12 has a further axial extension 27, which stands in, or can be brought into, engagement with the additional lever 23 designed as an inner activating lever, and which axially supports this additional lever 23 at one side.

As a result, the levers 11, 23, 24 of the lever stack 9 can be held in an axially defined position with the proposed solution, without this causing high manufacturing expense. The axial extension 27 protrudes through openings 28 in the release lever 24, which further improves the overall compact design.

According to a further teaching, the method is disclosed for producing the proposed motor vehicle lock 1 as such.

It is important in the proposed method that the activating lever 11 and the bearing sleeve element 12 in a premounting step form the aforementioned unit 14 by forming the bayonet fitting 13, wherein the premounted unit 14 is then mounted on the rest of the motor vehicle lock 1. The premounting occurs through the transition from FIG. 2 to FIG. 3. The mounting of the premounted unit 14 on the rest of the motor vehicle lock 1 occurs through the transition from FIG. 3 to FIG. 4.

In various embodiments, the motor vehicle lock 1 comprises an aforementioned bearing dome 21, wherein in a first step the at least one additional lever 23 is attached to the bearing dome 21, and in a second step the premounted unit is attached to the bearing dome 21. It can then be provided that in a third step the housing cover 8*a* is placed on the rest of the lock housing 8, whereby the bearing sleeve element 12 is supported axially.

In an easily fabricated embodiment, the bearing sleeve element 12 is made of a plastic material. The bearing dome 21 can be likewise made of a plastic material. The bearing sleeve element 12 and/or the bearing dome 21 can also be reinforced by other materials, especially by steel materials. In particular, it may be provided that the bearing dome 21 has a steel mandrel for mechanical reinforcement.

The invention claimed is:

1. A motor vehicle lock comprising:

a lock mechanism and a lock housing configured to receive the lock mechanism, wherein the lock mechanism comprises at least one activating lever which can swivel about a geometrical lever axis, wherein a bearing sleeve element is rotationally fixed to the lock housing, wherein the activating lever is radially mounted on the bearing sleeve element, wherein the activating lever is mounted on the bearing sleeve element axially at both sides and for this the activating lever is coupled to the bearing sleeve element by a bayonet fitting and in the process of installing the motor vehicle lock the activating lever and the bearing sleeve element is configured to be premounted to form a separate unit by creating the bayonet fitting.

2. The motor vehicle lock as claimed in claim 1, wherein the bearing sleeve element is designed rotationally fixed to the lock housing with respect to the lever axis.

3. The motor vehicle lock as claimed in claim 1, wherein the bayonet fitting is formed by a bayonet shape on the bearing sleeve element and by a mating bayonet shape on the activating lever.

4. The motor vehicle lock as claimed in claim 1, wherein the bayonet fitting can be brought into a locked condition and into an unlocked condition by swiveling the activating lever with respect to the bearing sleeve element about the lever axis and the bayonet fitting only provides the axially two-sided mounting between activating lever and bearing sleeve element in the locked condition, and in the unlocked condition the bayonet fitting allows a mutual axial movement of activating lever and bearing sleeve element.

5. The motor vehicle lock as claimed in claim 1, wherein the activating lever and the bearing sleeve element take up a locking swiveled position with respect to each other in the installed condition of the motor vehicle lock with respect to the bayonet fitting.

6. The motor vehicle lock as claimed in claim 1, wherein the bearing sleeve element is supported axially on two sides.

7. The motor vehicle lock as claimed in claim 1, wherein the bearing sleeve element has an axial extension.

8. The motor vehicle lock as claimed in claim 1, further comprising a bearing dome, wherein the bearing sleeve element is arranged coaxially to the bearing dome.

9. The motor vehicle lock as claimed in claim 8, wherein the bearing sleeve element is axially supported against a radial shoulder of the bearing dome.

10. The motor vehicle lock as claimed in claim 8, wherein the lock mechanism comprises at least one additional lever, able to swivel about the geometrical lever axis and wherein the at least one additional lever is mounted on the bearing dome.

11. The motor vehicle lock as claimed in claim 10, wherein at least one additional lever is mounted axially on two sides, by the bearing sleeve element, and by the bearing dome.

12. The motor vehicle lock as claimed in claim 10, wherein the bearing sleeve element comprises an axial extension, which can be brought into engagement with an additional lever mounted on the bearing dome and which supports this additional lever axially at one side.

13. A method for mounting a motor vehicle lock as claimed in claim 1, wherein the activating lever and the bearing sleeve element in a premounting step form a premounted unit by forming the bayonet fitting and wherein the premounted unit is mounted on the rest of the motor vehicle lock.

14. The method as claimed in claim 13, wherein the motor vehicle lock comprises a bearing dome and in a first step at least one additional lever is attached to the bearing dome, and in a second step the premounted unit is attached to the bearing dome.

15. The method as claimed in claim 14, wherein in a third step a housing cover is placed on the rest of the lock housing, and the bearing sleeve element is thus supported axially.

16. The motor vehicle lock as claimed in claim 2, wherein the bearing sleeve element comprises a support arm which is supported, in a rotationally fixed manner with respect to the lever axis, relative to the lock housing.

17. The motor vehicle lock as claimed in claim 5, wherein the activating lever and the bearing sleeve element are limited in their movement in the installed condition of the motor vehicle lock such that an unlocking of the bayonet fitting is blocked.

18. The motor vehicle lock as claimed in claim 6, wherein the bearing sleeve element is axially supported against one portion of the lock housing, especially against a housing cover.

19. The motor vehicle lock as claimed in claim 7, wherein the bayonet shape is arranged on the axial extension, and/or wherein the axial extension serves for the axial support of the bearing sleeve element against the lock housing and/or wherein the axial extension serves for receiving a spring element for the activating lever or another component of the lock mechanism.

20. The motor vehicle lock as claimed in claim 8, wherein the bearing sleeve element is attached to the bearing dome or inserted into the bearing dome or placed on the bearing dome.

* * * * *